US008960176B2

(12) United States Patent
Baumel

(10) Patent No.: US 8,960,176 B2
(45) Date of Patent: Feb. 24, 2015

(54) METERED BALL DELIVERY

(75) Inventor: Rachel Baumel, Denver, CO (US)

(73) Assignee: Ball Buddie LLC, Denver, CO (US)

( * ) Notice: Subject to any disclaimer, the term of this patent is extended or adjusted under 35 U.S.C. 154(b) by 561 days.

(21) Appl. No.: 13/277,248

(22) Filed: Oct. 20, 2011

(65) Prior Publication Data

US 2012/0103317 A1 May 3, 2012

Related U.S. Application Data

(60) Provisional application No. 61/456,242, filed on Nov. 3, 2010.

(51) Int. Cl.

| | |
|---|---|
| ***A63B 69/38*** | (2006.01) |
| ***G07F 11/44*** | (2006.01) |
| ***A63B 47/00*** | (2006.01) |
| ***A63B 69/40*** | (2006.01) |

(52) U.S. Cl.

CPC ..... *A63B 69/385* (2013.01); *G07F 11/44* (2013.01); *A63B 47/002* (2013.01); *A63B 69/40* (2013.01); *A63B 2220/12* (2013.01); *A63B 2220/62* (2013.01); *A63B 2220/801* (2013.01); *A63B 2220/833* (2013.01); *A63B 2225/15* (2013.01); *A63B 2225/20* (2013.01); *A63B 2225/50* (2013.01); *A63B 2225/72* (2013.01)

USPC ..... 124/78; 124/1; 473/422; 473/459; 700/231; 700/232; 700/236; 700/237; 700/241; 221/1

(58) Field of Classification Search

CPC ..... A63B 69/40; A63B 69/38; A63B 47/002; A63B 2225/50; A63B 2225/20; A63B 2243/0083; G07F 17/0042; G06Q 20/18

USPC ..... 124/1, 78; 473/422, 459; 700/231, 232, 700/236, 237, 241; 221/1

See application file for complete search history.

(56) References Cited

U.S. PATENT DOCUMENTS

| | | | | | |
|---|---|---|---|---|---|
| 3,125,775 | A | * | 3/1964 | Clifton | 15/97.1 |
| 3,277,879 | A | * | 10/1966 | Sayette | 124/26 |
| 3,894,657 | A | * | 7/1975 | Eckmayr | 221/265 |
| 4,021,036 | A | * | 5/1977 | Nelson et al. | 473/459 |
| 4,057,172 | A | * | 11/1977 | Olander | 221/10 |
| 4,086,903 | A | * | 5/1978 | Scott | 124/78 |
| 4,126,217 | A | * | 11/1978 | Bock | 194/291 |
| 4,168,695 | A | * | 9/1979 | Haller et al. | 124/16 |
| 4,269,163 | A | * | 5/1981 | Feith | 124/77 |
| 4,288,074 | A | * | 9/1981 | Kainz | 473/431 |
| 4,368,885 | A | * | 1/1983 | Katada et al. | 473/436 |
| 4,517,953 | A | * | 5/1985 | Osaka et al. | 124/17 |
| 4,563,999 | A | * | 1/1986 | Miehlich | 124/50 |
| 4,588,108 | A | * | 5/1986 | Knez et al. | 221/68 |
| 4,803,348 | A | * | 2/1989 | Lohrey et al. | 235/381 |
| 4,834,060 | A | * | 5/1989 | Greene | 124/78 |
| 4,841,945 | A | * | 6/1989 | Braden | 124/78 |
| 5,195,652 | A | * | 3/1993 | Hooghiemstra | 221/203 |
| 5,205,436 | A | * | 4/1993 | Savage | 221/7 |
| 5,490,493 | A | * | 2/1996 | Salansky | 124/78 |
| 5,673,812 | A | * | 10/1997 | Nelson | 221/82 |
| 5,769,064 | A | * | 6/1998 | Lu et al. | 124/21 |

(Continued)

*Primary Examiner* — Gene Kim
*Assistant Examiner* — Alexander Niconovich

(57) ABSTRACT

Methods and apparatus, for metered ball delivery. An apparatus includes a secure enclosure housing a reservoir of tennis balls, a battery power supply and a battery powered portable tennis ball machine, the secure enclosure and tennis ball machine communicating via a wireless network to determine a location of the portable tennis ball machine.

19 Claims, 1 Drawing Sheet

(56) References Cited

U.S. PATENT DOCUMENTS

| | | | | |
|---|---|---|---|---|
| 6,085,735 | A * | 7/2000 | Cheek, Jr. | 124/77 |
| 6,186,132 | B1 * | 2/2001 | Ko | 124/6 |
| 6,200,236 | B1 * | 3/2001 | Minami et al. | 473/496 |
| 6,220,452 | B1 * | 4/2001 | Yamashita et al. | 209/675 |
| 6,283,876 | B1 * | 9/2001 | Northcutt | 473/422 |
| 6,383,097 | B2 * | 5/2002 | Minami et al. | 473/496 |
| 6,488,020 | B1 * | 12/2002 | Rosas-Magallan | 124/78 |
| 6,776,732 | B2 * | 8/2004 | Parkinson et al. | 473/431 |
| 6,834,776 | B1 * | 12/2004 | Corvese | 221/277 |
| 6,886,715 | B2 * | 5/2005 | Lennox | 221/92 |
| 6,961,707 | B2 * | 11/2005 | Jenkins | 705/5 |
| 7,853,354 | B2 * | 12/2010 | Kuehnrich et al. | 700/241 |
| 7,898,439 | B2 * | 3/2011 | Bettez et al. | 340/999 |
| 8,483,871 | B2 * | 7/2013 | Kropp et al. | 700/237 |
| 8,781,623 | B2 * | 7/2014 | Leech et al. | 700/240 |
| 2003/0141315 | A1 * | 7/2003 | Chirnomas | 221/211 |
| 2005/0266787 | A1 * | 12/2005 | Broaddus | 453/57 |
| 2008/0200287 | A1 * | 8/2008 | Marty et al. | 473/459 |
| 2009/0005904 | A1 * | 1/2009 | Kuehnrich et al. | 700/241 |
| 2011/0012490 | A1 * | 1/2011 | Schwendemann | 312/326 |
| 2013/0130845 | A1 * | 5/2013 | Marty et al. | 473/459 |

* cited by examiner

METERED BALL DELIVERY

CROSS-REFERENCE TO RELATED APPLICATIONS

This application claims the benefit of U.S. Provisional Application No. 61/456,242, filed Nov. 3, 2010, and titled METERED TENNIS BALL DELIVERY SYSTEM, which is incorporated by reference in its entirety.

BACKGROUND OF THE INVENTION

The invention generally relates ball delivery systems and methods, and more particularly to metered ball delivery.

Sports involve training and training can be expensive. For example, tennis training is not always easy. For most people it requires having a partner to train with. If you are training alone you may be somewhat limited to what you can do. There is no realistic feeling if you are just practicing your serves by yourself. You absolutely need a partner that will be there to respond to them or at least help with keeping the exercise fast paced.

The same usually goes for being on the receiving end and hitting the ball back across the court. If you wanted to do this you would normally need a training partner to serve the tennis ball to you first.

To help train, many players use a tennis ball machine. A tennis ball machine is a device that works to help you perfect a particular stroke. The device can be angled to a specific direction which enables you to practice various directional strokes. It can be used both for intense training and casual exercise. Therefore, it is good for both tennis pros and people looking for a fun exercise to get in shape with.

Regrettably, the cost of such a teaching aid is beyond the means of the average tennis player.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention provides methods and apparatus for metered ball delivery.

In general, in one aspect, the invention features an apparatus including a secure enclosure housing a reservoir of tennis balls, a battery power supply and a battery powered portable tennis ball machine, the secure enclosure and tennis ball machine communicating via a wireless network to determine a position of the portable tennis ball machine.

BRIEF DESCRIPTION OF THE DRAWINGS

The invention will be more fully understood by reference to the detailed description, in conjunction with the following figures, wherein.

DETAILED DESCRIPTION

Figure 1:
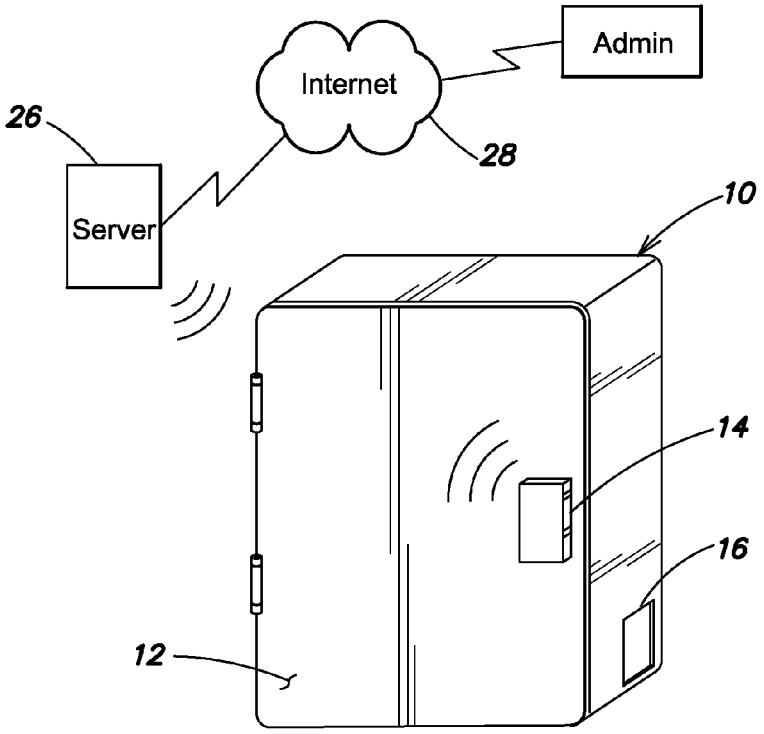
FIG. 1 is a block diagram of an exemplary locked secure enclosure.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

As shown in FIG. 1, an exemplary locked secure enclosure 10 includes a hinged door 12 secured by a lock 14. The lock 14 may be actuated by entering a key, a key code, swiping a credit/debit card, and so forth. In one specific example, the lock 14 is an I-Qwik Data Stand Alone Access control from MarksUSA of Amityville, N.Y. In another specific example, the lock 14 is an I-Qwik Data+Prox Digital Access Control Keypad or keypad with proximity reader from MarksUSA of Amityville, N.Y.

In one example, the lock 14 is monitored and actuated remotely over a wireless communication link.

The enclosure 10 can include a communication device, charging device and tennis ball reservoir. The communication device communicates with a portable tennis ball machine within. The charging device can mate with a charging port 16 on the tennis ball machine to provide charging power to the power supply, e.g., batteries, of the tennis ball machine. The tennis ball reservoir can monitor a level of tennis balls within the tennis ball machine when the tennis ball machine is housed in the enclosure 10. If the level of tennis balls signal a low condition, the reservoir is opened to tennis balls from the reservoir to fill a hopper of the tennis ball machine.

The charging device can be adapted to receive AC/DC power, solar power and/or wind power. When solar or wind power are used, the enclosure includes an external solar panel or small wind turbine. In one specific example, a solar power system is a pole that is 7'-8' high with a 14"×14" panel that provides 12 volts DC to a battery that provides power. The solar panel provides power for 5 days without sunlight, due to a battery life of 5 days. It is weather resistant and water proof.

In an example, the lock 14 on the enclosure is kept secured if the batteries in the tennis ball machine are depleted.

In one example, the enclosure 10 is constructed of weather resistant and theft resistant material, such as a galvanized steel or stainless steel. The electronics within the enclosure 10 are designed to operate over a wide range of temperatures, eliminating a need for enclosure insulation. In other examples, the enclosure is constructed of high impact plastic, composite or other metal.

In another example, the enclosure 10 includes external mounting hardware to secure the enclosure 10 to the ground, a fence, and so forth.

Figure 2:
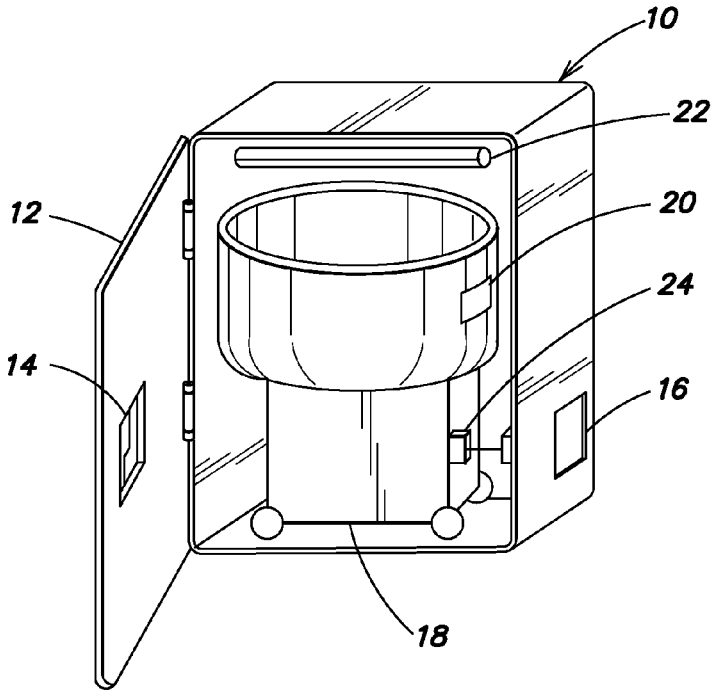
FIG. 2 is a block diagram of an exemplary open secure enclosure housing a tennis ball machine.

As shown in FIG. 2, when the door 12 to the enclosure 10 is opened the portable tennis ball machine 18 can be found within. A sensor 20 attached to the tennis ball machine 18 can be used to signal a return of the tennis ball machine 18 to the enclosure 10 and/or indicate that the tennis ball machine 18 is out of a predetermined range of the enclosure 10 and may be the subject of theft or damage.

In one example, the enclosure 10 includes a shelving unit cylinder 22 that contains the balls and is controlled by a microswitch. When the last ball is returned, the switch is triggered. If the cylinder 22 is not full then it will not trigger the microswitch and the customer will be billed.

The tennis ball machine 18 is battery-powered and can include a charging adapter 24 that mates with the charging port 16 of the enclosure 10 when positioned therein. The tennis ball machine 18 can include a battery monitor such that when the batteries are low an indicator, such as a light or audio sound, indicate such to a user, prompting the user to return the tennis ball machine 18 to the enclosure 10 for charging.

In another example, the tennis ball machine 18 is recharged by an administrator removing it and charging it at a separate location.

In a specific example, when the tennis ball machine 18 is activated a timer initiates. When the timer detects a predetermined amount of time has lapsed, the tennis ball machine 18 deactivates, prompting the user to return the tennis ball machine 18 to the enclosure 10.

In operation, in one example, a customer retrieves a personal identification number (PIN) code by logging onto a server 26 in a client/server network (e.g., Internet) 28 and inputting payment information, such as a credit/debit card number. The server 26 returns a unique personal numeric code.

At the enclosure 10, in one example, the customer enters a personal numeric code on a numeric keypad mounted on secure enclosure, thus unlocking it. The customer may now remove and use the portable tennis ball machine 18.

In another example, the lock 14 on the enclosure 10 is adapted to receive credit/debit card information directly and once approved, unlock the enclosure 10.

After a period of use, the customer returns the tennis ball machine 18 to the enclosure and locks the door 12 to the enclosure 10. Locking of the door 12 triggers the sensor 20 that the tennis ball machine 18 has been returned. The returned tennis ball machine 18 can trigger the door to lock.

In other examples, the enclosure 10 includes a tennis ball supply that the customer can use to fill the tennis ball machine before use. In a specific example, the supply is metered to limit the number of tennis balls added to the tennis ball machine by the customer.

In summary, in a preferred embodiment, the enclosure 10 is approximately three feet in height, thirty inches wide and two feet deep with the door 12 on the front. The door 12 to the enclosure 10 is preferably made of galvanized steel. The door 12 to the enclosure typically has rounded corners and the enclosure 10 color typically dark.

The enclosure 10 is typically not insulated yet the electronics within operate over a wide range of ambient temperatures.

Inside the enclosure 10 is a storage area with a shelf on a right top portion. The sensor 20 is inserted in the bottom back right corner of the storage area for detecting a presence of the ball machine 18.

In the preferred embodiment, the shelf in the upper right is designed to house batteries needed to power the system. The length of time the enclosure will operate is determined by usage; stand-alone time is approximately 72 hours. The dimensions of the shelf are approximately 12 inches high, 2 feet deep and 12 inches wide.

A ball hopper 22 is located in the front left side can hold a number of balls (e.g., 75-85). Residing on an outside of the enclosure 10 is directions for use.

Also located on the outside of the enclosure is a panel containing a personal identification number (PIN) pad 14. Each user accesses the inside of the enclosure using a numeric code. PIN numbers are assigned automatically to a user by a web site or personal phone call. Once a PIN number is entered, PIN number is verified and the enclosure 10 opened. The ball machine 18 within is then accessible to the user who rolls the ball machine 18 out for operation. The light weight of the ball machine 18 makes maneuvering easy. Balls used are refilled into the ball machine 18 before the user returns it to the enclosure 10. Once returned, the enclosure 10 automatically locks when the door 12 is closed.

The enclosure 10 can include a timer that tracks use for billing purposes and a sensor 20 to insure that the ball machine 18 is returned on time and not presumed stolen. The ball machine 18 is battery-powered and generally lasts for 4-6 hours. It is manually charged each day by an administrator.

More particularly, there is a hole penetrating an exterior of the enclosure 10 for a panel 16. All wiring is concealed to prevent accidental or intentional tampering. The keypad is powered by a 12 volt battery within the enclosure. The keypad is wired to the lock to control opening and closing of the enclosure. The keypad is also wired to a magnetic sensor 20 within the enclosure 10 that is activated when the ball machine is 18 placed within the enclosure 10. The sensor 20 deactivates the keypad and lock 14 when the ball machine 18 is removed, preventing the enclosure 10 from locking when the ball machine 18 is not within. Alternatively, the sensor 20 may be weight activated or tethered to a plug.

The keypad can collect of PINS that are used. This data can be collected using a wireless reader that captures data using, for example, a USB drive that can be transferred to a computer. PIN data may be used to verify usage and map usage to customers at which point their charge card can be charged an appropriate amount. The data transfer occurs periodically, such as once a week.

The foregoing description does not represent an exhaustive list of all possible implementations consistent with this disclosure or of all possible variations of the implementations described. A number of implementations have been described. Nevertheless, it will be understood that various modifications may be made without departing from the spirit and scope of the systems, devices, methods and techniques described here. For example, various forms of the flows shown above may be used, with steps re-ordered, added, or removed. Accordingly, other implementations are within the scope of the following claims.

What is claimed is:

1. An apparatus for enabling rental of a tennis ball machine, comprising:

a secure housing;

wherein the secure housing is sized to receive a tennis ball machine and, when the tennis ball machine is enclosed within the secure housing, the tennis ball machine is not usable but is removable from the secure housing for use;

the secure housing comprising structure defining an opening, wherein the tennis ball machine is removable from the secure housing through the opening;

the secure housing further comprising a sensor that detects whether the tennis ball machine is within the secure housing or outside of the secure housing; and the secure housing further comprising a device that receives information associated with individuals for authorization and billing of use of the tennis ball machine.

2. The apparatus of claim 1 wherein the structure defining the opening of the secure enclosure comprises a door secured by a lock.

3. The apparatus of claim 2 wherein the lock is actuated by the device.

4. The apparatus of claim 3 wherein the device comprises a keypad.

5. The apparatus of claim 2 wherein the sensor deactivates the keypad and lock when the tennis ball machine is removed from the secure housing to prevent locking of the door closed when the tennis ball machine is not within the secure housing.

6. The apparatus of claim 1 wherein the tennis ball machine is battery powered and wherein the secure housing comprises a charging port that connects to the tennis ball machine to charge a battery of the tennis ball machine.

7. The apparatus of claim 1, wherein the secure housing further comprises a ball reservoir for containing a supply of tennis balls.

8. The apparatus of claim 7 wherein the tennis ball machine is filled from the reservoir when a low level of tennis balls is detected within the tennis ball machine.

9. A secure housing for enabling rental of a tennis ball machine, comprising:

structure defining an enclosure with an opening, wherein the tennis ball machine is removable from the secure housing through the opening, wherein the secure housing is sized to receive a tennis ball machine and, when the tennis ball machine is enclosed within the secure housing, the tennis ball machine is not usable but is removable from the secure housing for use;

a sensor that detects whether the tennis ball machine is within the secure housing or outside of the secure housing; and a device that receives information associated with individuals for authorization and billing of use of the tennis ball machine.

10. The apparatus of claim 9, wherein the opening can be closed and secured with a lock, wherein the tennis ball machine is removable from the secure housing through the opening when the opening is not locked, and wherein the lock can be unlocked using the device that receives information associated with individuals for authorization to use the tennis ball machine.

11. The apparatus of claim 9, wherein the opening can be closed and locked when the sensor detects the tennis ball machine within the housing and wherein, when the sensor detects the tennis ball machine outside the housing, the opening cannot be locked closed.

12. The apparatus of claim 9, wherein the tennis ball machine has a hopper for holding tennis balls, the apparatus further comprising a reservoir within the housing for holding tennis balls and wherein, when the tennis ball machine is within the housing, the reservoir monitors a level of tennis balls in the hopper, and adds tennis balls to the hopper from the reservoir when a low level of tennis balls is detected in the hopper.

13. The apparatus of claim 9, further comprising a timer in the secure housing that tracks use of the tennis ball machine based on the sensor.

14. The apparatus of claim 9, wherein the tennis ball machine is battery powered and wherein the secure housing includes a charging port that connects to the tennis ball machine to charge a battery of the tennis ball machine.

15. An apparatus for enclosing a tennis ball machine having a hopper for holding tennis balls, comprising:

a housing;

a reservoir for holding tennis balls in the housing;

wherein the housing is sized to receive the tennis ball machine and, when the tennis ball machine is enclosed within the housing, the tennis ball machine is not usable but is removable from the housing for use;

wherein, when the tennis ball machine is enclosed within the housing, the reservoir monitors a level of tennis balls in the hopper of the tennis ball machine, and adds tennis balls to the hopper of the tennis ball machine from the reservoir when a low level of tennis balls is detected in the hopper; and wherein the tennis ball machine is battery powered and wherein the housing includes a charging port that connects to the tennis ball machine to charge a battery of the tennis ball machine.

16. The apparatus of claim 15, wherein the housing includes an opening that can be closed and secured with a lock, wherein the tennis ball machine is removable from the housing through the opening.

17. The apparatus of claim 16, wherein the lock is unlocked using a device that receives information associated with individuals for authorization to use the tennis ball machine.

18. The apparatus of claim 15, wherein the housing further comprises a sensor that detects whether the tennis ball machine is within the housing.

19. An apparatus for enclosing a tennis ball machine having a hopper for holding tennis balls, comprising:

a housing;

a reservoir for holding tennis balls in the housing;

wherein the housing is sized to receive the tennis ball machine and, when the tennis ball machine is enclosed within the housing, the tennis ball machine is not usable but is removable from the housing for use;

wherein, when the tennis ball machine is enclosed within the housing, the reservoir monitors a level of tennis balls in the hopper of the tennis ball machine, and adds tennis balls to the hopper of the tennis ball machine from the reservoir when a low level of tennis balls is detected in the hopper; and wherein the housing further comprises a sensor that detects whether the tennis ball machine is within the housing, and wherein the opening can be closed and locked when the sensor detects the tennis ball machine within the housing and wherein, when the sensor detects the tennis ball machine outside the housing, the opening cannot be locked closed.

* * * * *